US010959501B2

(12) United States Patent
Whitehead

(10) Patent No.: US 10,959,501 B2
(45) Date of Patent: Mar. 30, 2021

(54) APPARATUS AND METHOD FOR THE WEAVING OR INTERWEAVING OF ELONGATE MEMBERS TO FORM BRAIDS OR PLAITS

(71) Applicant: Fuse London Ltd, London (GB)

(72) Inventor: Brian Whitehead, Kent (GB)

(73) Assignee: Fuse London Ltd, London (GB)

( * ) Notice: Subject to any disclaimer, the term of this patent is extended or adjusted under 35 U.S.C. 154(b) by 703 days.

(21) Appl. No.: 15/288,466

(22) Filed: Oct. 7, 2016

(65) Prior Publication Data

US 2017/0099927 A1 Apr. 13, 2017

(30) Foreign Application Priority Data

Oct. 9, 2015 (GB) ..... 1517902.1

(51) Int. Cl.

| | |
|---|---|
| ***A45D 8/34*** | (2006.01) |
| ***D04C 7/00*** | (2006.01) |
| ***A45D 2/00*** | (2006.01) |
| ***A45D 7/00*** | (2006.01) |

(52) U.S. Cl.

CPC ..... *A45D 8/34* (2013.01); *A45D 2/00* (2013.01); *D04C 7/00* (2013.01); *A45D 2002/005* (2013.01); *A45D 2007/004* (2013.01)

(58) Field of Classification Search

CPC ..... A45D 2/00; A45D 2002/003; A45D 2002/005; A45D 2002/006; A45D 2007/004; D04C 7/00

See application file for complete search history.

(56) References Cited

U.S. PATENT DOCUMENTS

| | | | | |
|---|---|---|---|---|
| 4,369,690 A * | 1/1983 | Sapkus | ..... | A45D 2/00 132/212 |
| 7,905,237 B2 | 3/2011 | Noh | | |
| 2002/0092540 A1 * | 7/2002 | Lee | ..... | A45D 2/00 132/270 |
| 2005/0039769 A1 * | 2/2005 | Bousfield | ..... | A45D 2/00 132/271 |
| 2016/0331098 A1 * | 11/2016 | Chen | ..... | A45D 1/00 |

* cited by examiner

*Primary Examiner* — Edward Moran

(74) *Attorney, Agent, or Firm* — Head, Johnson, Kachigian & Wilkinson, PC

(57) ABSTRACT

The present invention provides apparatus and a method for use in weaving elongate members together and most typically elongate members in the form of hair attached to the head of a person or a toy doll. The elongate members are provided in groups and the groups pass through passages in a weaving mechanism and along guide tubes which are located to the opposing side of the weaving mechanism from the item to which at least some of the elongate members are attached. Typically, relative movement of the weaving mechanism along the elongate members and the operation of the weaving mechanism cause the weave, such as in the form of plaiting, braiding or cornrowing to be formed.

2 Claims, 7 Drawing Sheets

APPARATUS AND METHOD FOR THE WEAVING OR INTERWEAVING OF ELONGATE MEMBERS TO FORM BRAIDS OR PLAITS

BACKGROUND OF THE INVENTION

1. Field of the Invention

The invention to which this application relates is apparatus for the weaving or interweaving of elongate members and examples of the weaving types are plaiting, braiding or cornrowing. Reference herein to weaving should be interpreted as relating to these examples and other possible forms.

2. Description of the Related Art

The elongate members to which the invention relates is particularly, although not necessarily exclusively, to lengths of hair, whether the hair is real or false and provided in attachment to the persons head, provided as extensions or provided as hair for a toy character. However, reference hereonin to hair should not be interpreted as excluding any other form of elongate member with which the apparatus and method may be used, such as ribbons, strands or the like.

The provision of the weaving of hair is a well-known form of decoration and/or cultural effect which has been practiced for many years and indeed centuries.

The conventional approach has been for a person's hair to be woven manually and, due to the difficulties in the person whose hair is being woven physically achieving this themselves, the weaving is most typically performed by a second person due to the better access, and hence better quality, of the weaving effect which can be achieved. However, this process is time consuming which means that often the weaving of the hair is not done at all due to time constraints, or, if the weaving is to be done on a commercial basis by the second person, the time required to be taken makes the cost of performing the weaving to be prohibitive.

More recently, attempts have been made by third parties to provide apparatus which allows the automated weaving to be achieved, which therefore reduces the time required to achieve the weaving whilst attempting to maintain the quality of the weave. In certain instances, the apparatus is designed to allow a person to use the apparatus to weave their own hair.

However, in practice, it is found that the quality of the weave which is achieved is quite often of inferior quality to that which can be achieved manually. Also, with certain of the apparatus, the same is relatively large and appears to be complicated to use, which can dissuade persons from purchasing and using the apparatus. For example, the apparatus disclosed in U.S. Pat. No. 7,905,237 shows a weaving mechanism which receives lengths of hair which are stored in an overlapping manner in feed tubes which extend between the weaving mechanism and the persons head from which the hair extends. This means that the hair which is to be woven extends between the weaving mechanism and the head and the feed tubes in which the hair is located are driven along respective rotating paths to cause the weave to be formed. However, the provision of the feed tubes in this manner and the need for the same to be able to receive considerable lengths of hair makes the apparatus cumbersome to use and there is a risk of entanglement of the feed tubes and/or hair. It is also believed that the distance of the weaving mechanism from the head means that the weave which is created is relatively imprecise and therefore may not be acceptable to many potential users of the apparatus.

Other known forms of weaving apparatus include relatively complex multigear or multi motor apparatus and the synchronisation of the same is found to be problematic and/or expensive to achieve.

An aim of the present invention is to provide apparatus which allows the weaving of elongate members, such as hair, to be achieved in an efficient manner and with a quality which at least matches that which can be achieved manually. A further aim is to provide apparatus which minimises the possibility of the hair being entangled or damaged. A yet further aim is to provide the apparatus in a form which allows the same to be used to achieve the weaving effect by a person using the apparatus on their own hair.

SUMMARY OF THE INVENTION

In a first aspect of the invention the e is provided apparatus for the weaving together of a plurality of elongate members, said apparatus comprising a waving mechanism provided to move and weave respective elongate members together, guide tubes in which the respective elongate members are received and wherein the said guide tubes are located to a first side of the weaving mechanism and an item to which at least some of the elongate members are attached is located to the opposing side of the said weaving mechanism, passages are provided in the weaving mechanism to allow the elongate members to pass through the weaving mechanism and into the guide tubes and there is relative movement between the weaving mechanism and the elongate members as the weaving mechanism is operated to form the weave in the elongate members.

In one embodiment the relative movement is achieved by moving the weaving mechanism along the elongate members as the weaving mechanism is operated.

In one embodiment a start position for the weaving mechanism is closer to the said item than the finish position for the weaving mechanism.

In one embodiment at least the weaving mechanism is moved from a starting position adjacent to the item to a finished position further removed from the said item, while the mechanism is operated to create the weave.

In one embodiment the apparatus uses a single motor connected to a crank and connecting arm which, in turn, is located to drive a gearing mechanism to provide a sinusoidal motion. The sinusoidal motion which is achieved allows a relatively smooth operation of the weaving mechanism and, in turn, more accurate weaving effect to be achieved.

In one embodiment the gearing mechanism includes first and second mechanical clutches which are connected to the crank via the gearing mechanism assembly.

Typically, a cam mechanism is provided to stop and release first and second rotatable guides such that when the weaving mechanism is being operated one of the rotatable guides is held in a fixed location while the other of the rotatable guides is rotated and the sequence of rotation of the first and second guides is provided in an accurately repeatable sequence.

Typically, in addition to the cam mechanism, there is provided a secondary stop mechanism such as a cantilever or two, separate, one way stops. The secondary stop mechanism prevents the reverse movement of the rotatable guides against the direction of rotation in which the same are to be driven.

Typically, the guide tubes are moved with the weaving mechanism as the same is moved between the start and finish positions.

In one embodiment the elongate members which are to be woven are provided in groups, with a first group located along and through a first guide tube, a second group located along and through a second guide tube, and so on with as many elongate member groups as are to be woven.

Typically, each of the guide tubes is selectively attachable to a respective passage which is provided to pass through the weaving mechanism.

Typically, each passage extends from the side on which the guide tubes are located to the side closest to the item and the elongate members which extend from the item pass through respective passages and into the respective guide tubes.

In one embodiment the guide tubes are extendable in length an as to be adjustable with respect to the particular length of the elongate members which are to be accommodated therein.

In one embodiment means are provided to allow the elongate members to be pulled through and thereby lie along the interior of the guide tubes prior to operation of the weaving mechanism. In one embodiment the apparatus includes at least one hook portion which extends beyond the open end of a passage in the weaving mechanism and to the side of the weaving mechanism closest to the said item to engage with a group of elongate members and the hook portion is moved through the passage and the guide tube located therewith to draw the group of elongate members through the passage and guide tube, whereupon the hook portion is then removed and the operation of the weaving mechanism can commence once each of the groups of elongate members have been moved so as to be in the same position with respect to the said guide tubes.

In one embodiment additional elongate members which may be attached to the said item can be woven with one or more elongate members which are attached to the item.

Typically, the said item is the head of the person and the elongate members are, or include, hair which extends from the person's head.

In one embodiment each passage in the weaving mechanism is formed and located in a respective shuttle, each of said shuttles selectively driven by the rotatable guides to be moved in a predefined path such the combined movement of the shuttles in a predefined manner allows the weave of the elongate members to be created.

In one embodiment each of the shuttles is moved in a figure of eight path with the movement typically occurring in stages of movement interspersed with the shuttle being held stationery.

Typically, the shuttles are selectively moved via the rotatable guides which are, in turn, driven by a gearing mechanism powered by the motor.

Typically, the movement imparted to the shuttles via the rotatable guides is sinusoidal in form and the sinusoidal movement allows a change in the speed of movement during a sequence from an at rest position at the time of changeover between movement of a first of the rotatable guides and movement of the other of the rotatable guides, and then accelerated movement of one of the rotatable guides from the at rest position during the sequence. At the end of the sequence that rotatable guide is returned to an at rest position and the other of the rotatable guides is then moved in the same sequence, and so on with alternative rotatable guide movement.

Typically, the motor is connected to a power source which, in one embodiment, may be formed by one or more power cells provided as part of the apparatus or, alternatively, a mains power supply can be connected to the apparatus.

Alternatively, the gearing mechanism is driven by manual actuation means such as via a crank lever which is hand operated by a person.

In one embodiment the rotatable guides intersect and the shuttles are located in recesses in respective rotatable guides so as to be driven by the same and hence moved between said rotatable guides so as to achieve the figure of eight movement path. In one embodiment, the rotatable guides are driven to rotate about respective pivot axes. In one embodiment the rotatable guides are formed with a diameter across the non-recessed portions and the length of the diameter is greater than the distance between the said pivot axes.

Typically, the rotatable guides are located on their respective axes and each guide has a first and second recess extending inwardly from its periphery. Typically, the said first and second recess portions are offset by 180 degrees about the axis of the rotatable guide.

Typically, the recess portion in a first of the rotatable guides is shaped such that the peripheral path of the edge of the other of the rotatable guides lies substantially flush with the recess side wall. Typically the shuttle is shaped such that a first side face of the shuttle continues in line with the periphery of a first of the rotatable guides when located in a recess therein and therefore lies flush with the side wall of the recess in the second rotatable guide when located therein, and an opposing second side face of the shuttle continues in line with the periphery of the second of the rotatable guides when located in a recess therein and therefore lies flush with the side wall of the recess in the first rotatable guide when located therein.

Typically, the rotatable guides are driven to rotate between predefined stop points so as to achieve the required movement paths of the shuttles in a synchronised manner. The predefined stop points are defined by the use of the cam mechanism and are supported by the provision of the secondary stop mechanism.

In one embodiment the cam mechanism allows the selective movement of the first and second guides and assists in defining the stop points for the movement of the said guides.

In one embodiment gearing mechanism includes a torque limiter which operates to prevent excessive torque from being generated and hence prevents possible damage to the elongate members and/or the weaving mechanism.

In one embodiment the apparatus includes a device for separating the elongate members into groups of elongate members and thereby allows the groups of elongate members to be more easily fed into the respective guide means.

Typically, the device includes a neck portion into which the elongate members can be placed, with the device angularly offset to the longitudinal axes of the elongate members. Typically, the neck portion leads into a plurality of branch slots and the elongate members are respectively moved into the said branch slots to thereby separate the same into groups of elongate members with one group being formed in each of the respective branch slots.

In one embodiment a locking means is provided to "lock" the elongate members into the slots and against the body of the device so as to grip the elongate members to the body of the device and aid in the retention of the same in the separate groups.

In a further aspect of the invention there is provided a method of weaving together elongate members into a braid or plait, said method comprising the steps of providing a plurality of groups of the elongate members which are to be woven, a weaving mechanism to allow said groups of the elongate members to be woven thereby, feeding the said groups into and along respective guide tubes from which the elongate members are fed to the weaving mechanism and wherein the said groups of the elongate members are initially fed from a first side of the weaving mechanism through respective passages in the weaving mechanism and into the respective guide tubes mounted on an opposing side of the weaving mechanism and moving the weaving mechanism along the elongate members as the weaving mechanism is operated.

In one embodiment a start position for the weaving mechanism is closer to the said item than the finish position for the weaving mechanism In one embodiment the length of the guide tubes are extendable in length so as to aid the housing of longer length elongate members.

In one embodiment the elongate members have a free end which is passed through the guide tubes and the opposing end is attached to an item which, when the elongate members are hair, is the head of a person.

In one embodiment the weaving mechanism is moved away from the item to which one end of the elongate members is attached as the plait or braid is formed and until the same has been formed to a desired length.

In one embodiment the apparatus includes at least one hook portion which extends beyond the open end of a passage in the weaving mechanism and to the side of the weaving mechanism closest to the said item to engage with a group of elongate embers and the hook portion is moved through the passage and the guide tube located therewith to draw the group of elongate members through the passage and guide tube, whereupon the hook portion is then removed and the operation of the weaving mechanism can commence once each of the groups of elongate members have been moved so as to be in the same position with respect to the said guide tubes.

In a further aspect of the invention there is provided a device for separating the elongate members into groups of elongate members wherein said device includes a neck portion into which the elongate members can be placed, said neck portion leading to a plurality of branch slots and the elongate members are selectively moved into the said branch slots to thereby separate the same into groups of elongate members with those elongate members in a particular branch slot forming a group of elongate members.

In one embodiment the elongate members are placed into the neck portion and branch slots at a position adjacent to an end of the elongate members and a locking member is placed across the body and hair.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1A:
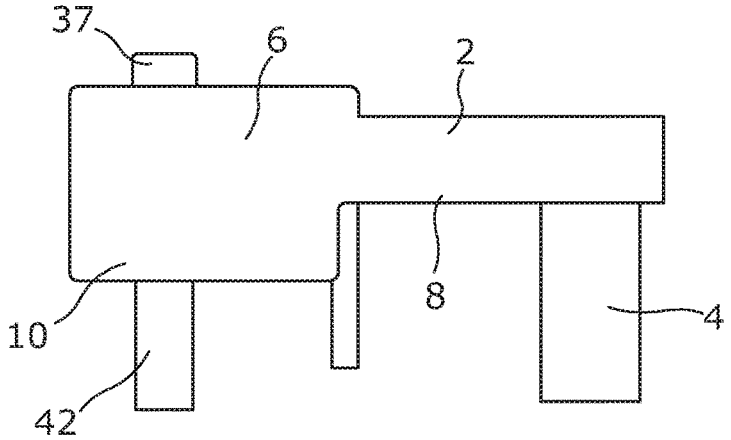
FIGS. 1*a*, 1*b* and 1*c* illustrate alternate views of the apparatus in accordance with one embodiment of the invention.
Figure 1B:
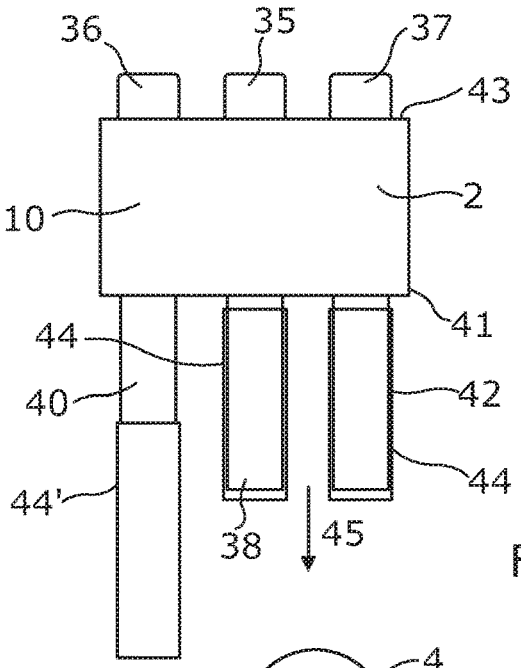
Figure 1C:
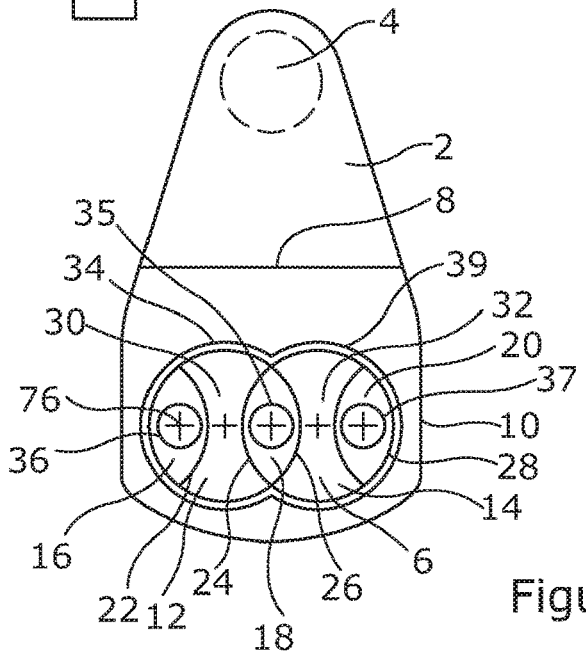

Referring firstly to FIGS. 1*a-c* there is shown apparatus in a form in accordance with one embodiment of the invention. The apparatus includes a housing 2 which is formed at one end with a handle portion 4 by which the apparatus can be ripped in use. The handle portion of the housing can also be used to locate therein a power supply connection and/or power cells and/or a manually operated lever to allow power to operate the weaving mechanism of the apparatus. When a power supply or power cells are provided they are connected to operate a motor which is provided to drive the weaving mechanism via a gearing mechanism located in the portion 8 of the housing. The gearing assembly is connected to move a weaving mechanism 6 located at the portion 10 of the housing. The weaving mechanism includes rotatable guides 12, 14 and shuttles 16, 18, 20. The shuttles are provided to be received in respective recesses 22, 24, 26, 28 formed in the rotatable guides 12, 14.

The rotatable guides are provided to be rotatably moveable about respective axes 30, 32 and, as they do, they move the shuttles along with the same so as to move and change the relative positioning of the shuttles with respect to the recess portions and the rotatable guides and thereby create the weaving effect. The shuttles are confined to movement with the recesses 22, 24, 26, 28 by contact with the respective rotatable guides 12, 14 and the side walls 34 of the aperture 39 of the housing 2 and in which the rotatable guides and shuttles are mounted.

Each of the shuttles is provided with a passage 35, 36, 37 and, at one opening into each passage, as shown, a guide tube 38, 40, 42 is connected to each of the passages on the side 41 of the housing 2. The opposing openings into the passages 35, 36, 37 are provided at the opposing side 43 of the housing and sit will be appreciated that the passages 35, 36, 37 extend from side 43 to side 41 of the housing 2 and pass through the weaving mechanism.

The guide tubes also include, in this embodiment, extendable portions 44 which in this embodiment are provided to be telescopically extendable as indicated in FIG. 1*b* with one of the extendable portions 44', having been moved to the extended position to extend the length of the guide tube 40. In another embodiment the extendable portion can be provided in the form of bellows. The extendable portions 44 can each be extended downwardly as indicated by arrow 45 so as to lengthen the guide tubes to the required length to provide guidance for the extendable members which pass therethrough and thereby prevent tangling along the length of the respective elongate members.

Figure 5A:
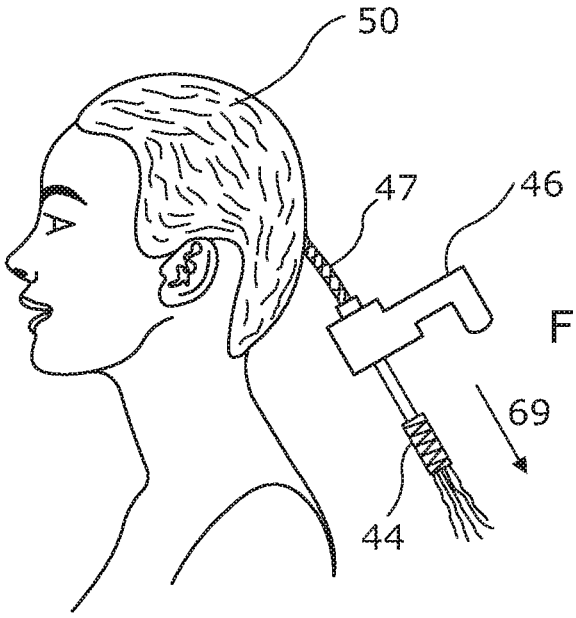
FIGS. 5*a*, 5*b* and 5*c* illustrate in a schematic manner, the use of the apparatus in accordance with one embodiment of the invention.

Turning now to FIG. 5*a* there is illustrated the apparatus as herein described by the general numeral 46. The apparatus is shown in location with respect to several groups 54, 56, 58 of elongate members which have been partially already woven together in FIG. 5*a* to form a plait or braided section 47. In this example, all of the elongate members are strands of hair but they could equally be fake hair, extensions, ribbons or the like.

Figure 5C:
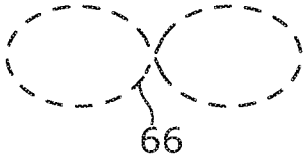
Figure 5B:
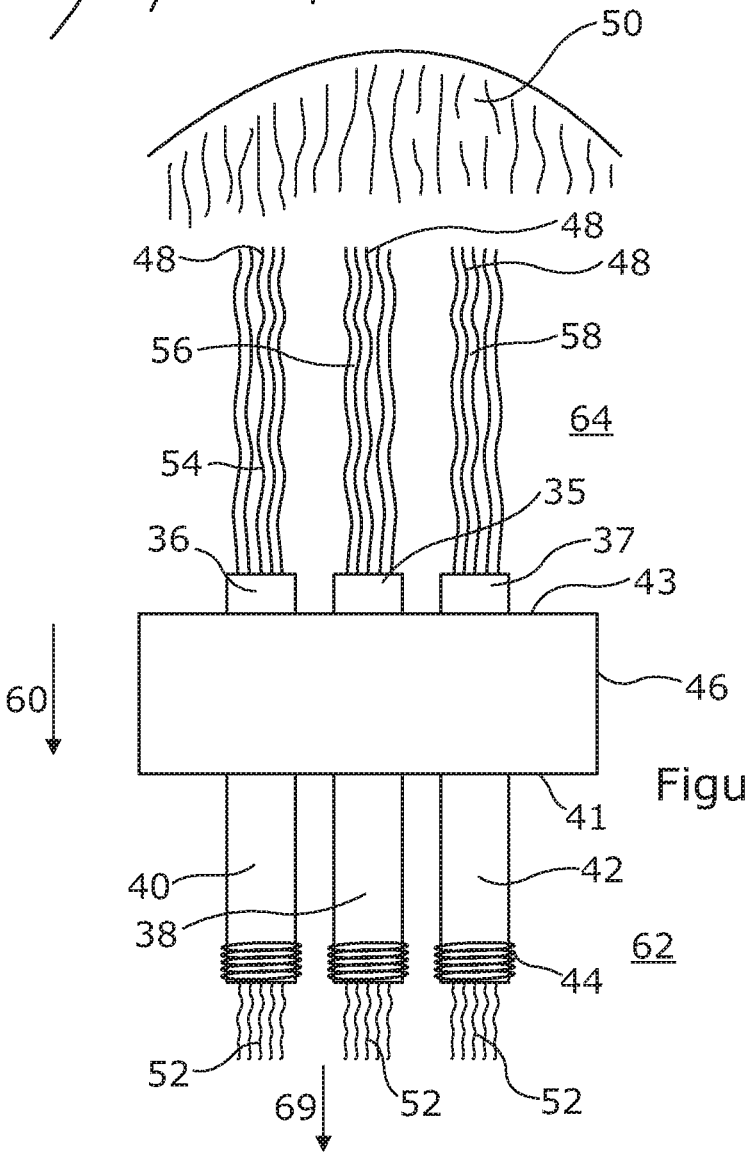

As shown in FIG. 5*b*, in this example, the elongate members are split into three groups 54, 56, 58 along their length, although more groups could be woven using adapted apparatus. Each of the groups of elongate members has one end 48 attached to an item, in this case the head 50 of the person whose hair is to be braided. The opposing, free ends 52 of the elongate member groups 54, 56, 58 are respectively moved into and through the passages so that the free ends of the group 54 are moved into passage 36, the free ends of the group 56 are moved into passage 35 and the free ends of the group 58 are moved into passage 37 at the side 43 of the apparatus housing. The groups of elongate members are then continued to be moved through the passages 35, 36, 37 to the side 41 of the housing and then into the respective connected guide tubes 40, 38, 42 respectively in the direction as indicated by arrow 60, until the elongate members are fully passed through the tubes and the apparatus 46 is now at a start position which is relatively close to the persons head 50.

With the groups of elongate members 54, 56, 58 in the required position and extending along the guide means 40, 38, 42 to the side 62 of the apparatus 46 and the persons head 50 at the opposing side 64 of the apparatus 46, so the weaving mechanism can then be operated to cause the movement of the shuttles 16, 18, 20 by the rotatable guides 12, 14, with the shuttles moving in a stop start staggered fashion and following a figure of eight pattern as illustrated in FIG. 5*c* by broken lines 66, such that the relative movement of the shuttles causes the weaving of the elongate members to be achieved.

As the weaving mechanism is operated, so the person holding the apparatus, which may be the same person whose hair is being braided or plaited, or may be a different person, moves the apparatus 46 progressively away from the head 50 in the direction of arrow 69 shown in FIG. 5*a* so as to cause the braid or plait 47 to be formed to the desired length along the length of the elongate members. When the weave has been completed to the required length or the free ends 52 of the elongate members has been reached, the waving mechanism is at the finish position which is a distance from the head 50 which is greater than the distance of the weaving mechanism from the head 50 at the start position. The weaving mechanism can then be switched off and any remaining non-braided elongate members removed from the apparatus guide means.

Figure 2:
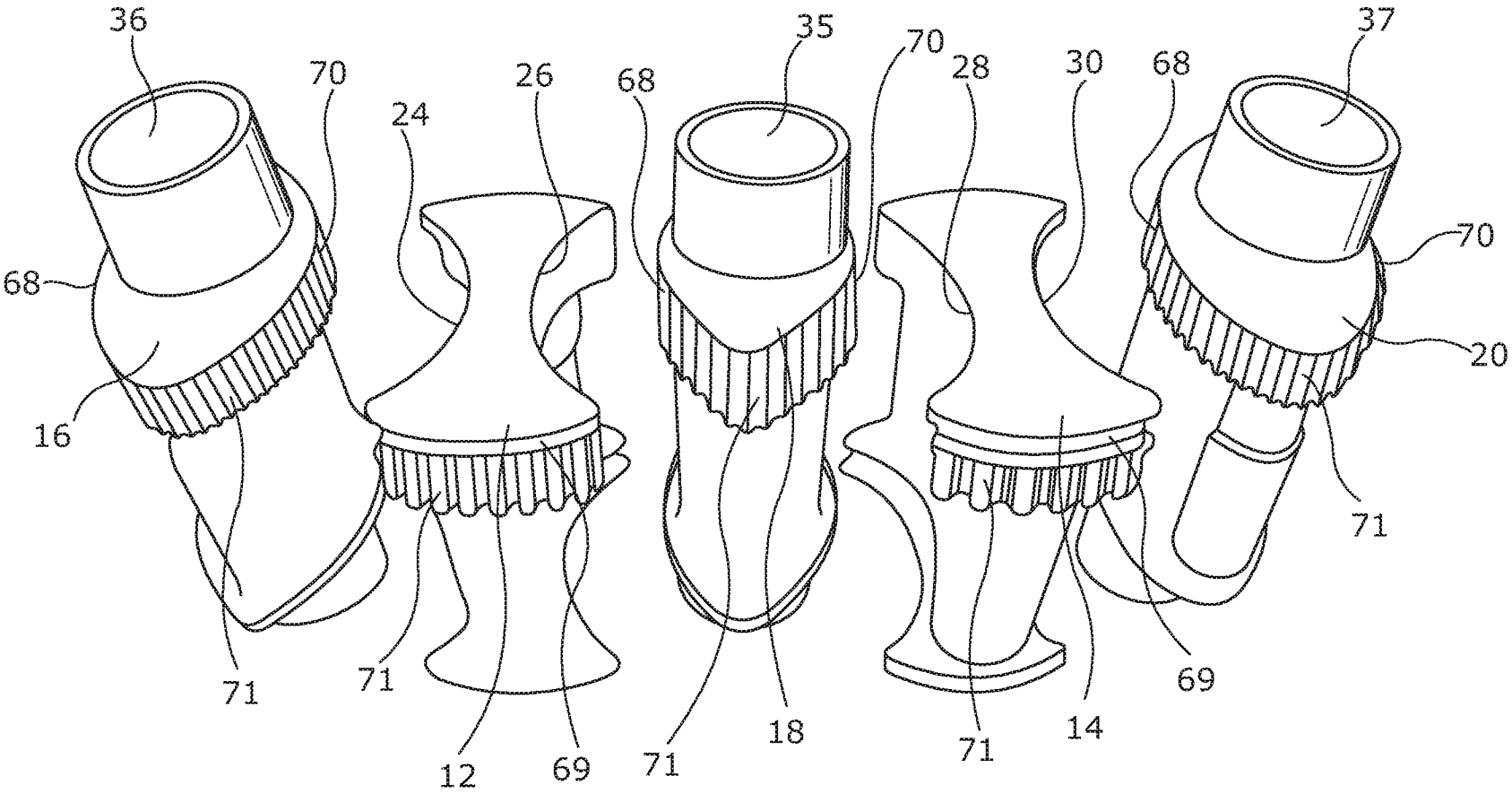
FIG. 2 illustrates one embodiment of shuttle and guide components of the apparatus.

Turning now to FIG. 2 there is illustrated in greater detail the shuttles 16, 18, 20 and rotatable guides 12, 14. Each of the shuttles are provided with first and second opposing side walls 68, 70 which are provided to be received in a recess 24, 20, 28, 30 of the rotatable guides. In this example the side walls of the shuttles and non-recessed portions of the rotatable guides are provided with engaging drive teeth 71 and location means 69 so as to maintain the shuttles so that they lie in the same plane as the rotatable guide.

Figure 4A:
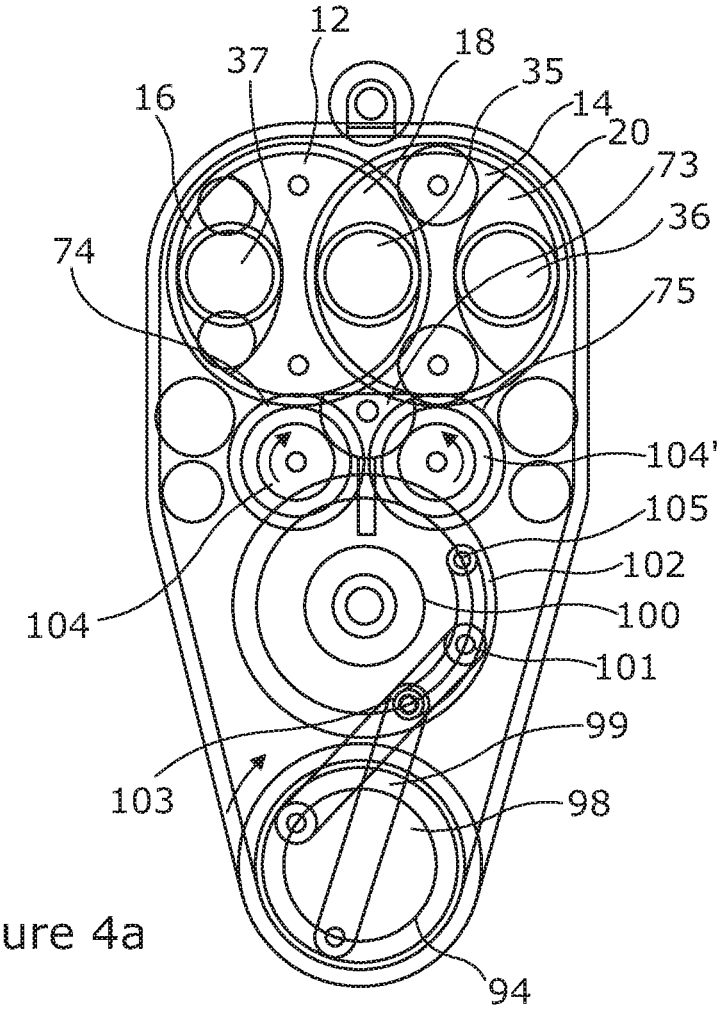
FIGS. 4*a* and 4*b* illustrate alternate views of the gearing mechanism in one embodiment.
Figure 4B:
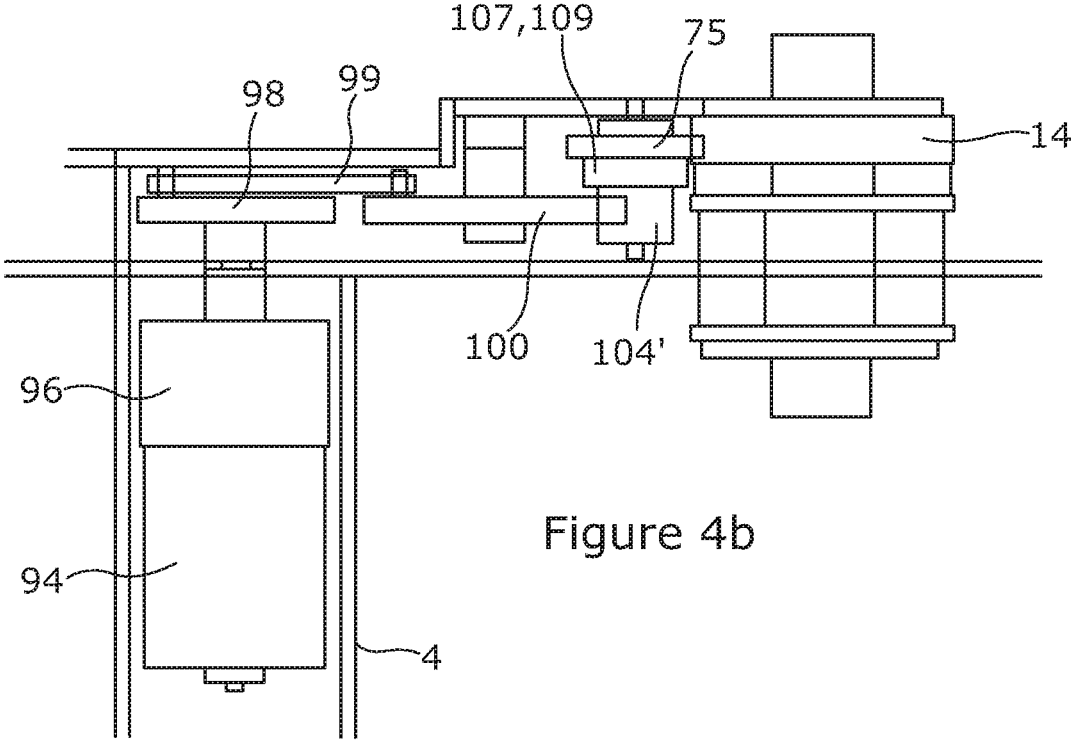

FIGS. 4*a* and *b* illustrate one embodiment of a gear and drive mechanism which is connected to move the rotatable guides 12, 14 and hence the shuttles 16, 18, 20. Control means in the form of a cam 73 shown in FIG. 4*a* is provided so as to ensure that the rotatable guides are driven in a sequential manner such that, during operation, one of the rotatable guides 12, 14, and the two of the three shuttles in connection therewith are moved at an instant of time and the rotatable guides are moved in a synchronised manner in order to provide the required movement sequence of the shuttle movement to create the braid or plait.

Figure 3:
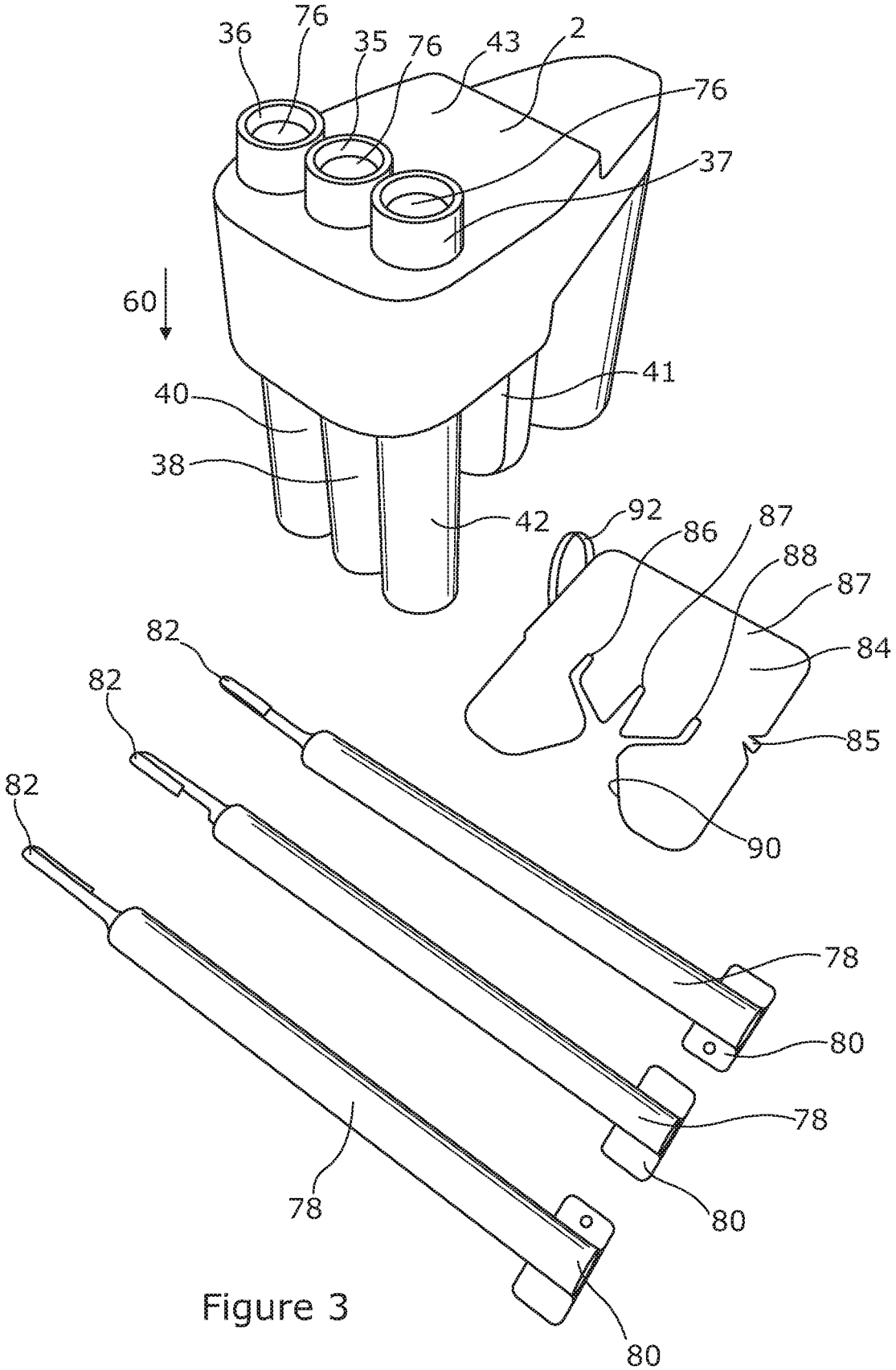
FIG. 3 illustrates the guide means, separating device and weaving mechanism in accordance with one embodiment of the invention.

FIG. 3 illustrates the separate components which, in combination, form a preferred embodiment of the invention. The housing 2 is shown in a form ready for use and it should be noted that the passages 35, 36, 37 are provided with resilient means 76 which lie across the opening into the same at side 43 in order to allow the elongate members to be passed through the same, but also to allow the resilient means to exert a biasing force to maintain the elongate members in position with respect to the passage. In one embodiment the resilient means is formed by a flexible plastics sheet material which is semi rigid and elastic with a series of slits formed therein and which, when a force is applied thereto, causes a sufficient space to be formed to allow the group of elongate members to be passed therethrough.

The guide tubes 38, 40, 42 are located to the respective passages and extend from the opposing side 41 of the housing. In this embodiment a hook and elongate member device 78 is provided for each tube and which can pass along the length of the tube. At one end there are provided gripping fins 80 which can be gripped by the user to move the device 78 with respect to the tube and passage in which the same is located. At the opposing end of the device 78 there is provided a hook portion 82 which, when the portion 78 is in the guide tube to load the guide tube, extends through the passage 35, 36, 37 and beyond the same to protrude at the side 43.

At the commencement of loading the apparatus, then a further device 84 is positioned near the ends of the elongate members close to the head 50. The device 84 separates the elongate members into groups, in this case up to three groups 54, 56, 58. The device includes a neck portion 90 connected to three branch slots 86, 87, 88 into which the respective separated groups of elongate members 54, 56, 58 are positioned. The device can also be provided with locking means 92 which when the elongate members are in position, is extended across the body 87 to locator 85 to thereby retain the elongate members to the body 87. With the groups 54, 56, 58 separated and held by the device, the apparatus can be moved into position with a hook portion protruding from the passage opening at side 43. Each group of elongate members is released from the device 84 and then passed around a respective hook portion 82 and when this has been done, each of the devices 78 is pulled in the direction 60 to move the h ok portions 82 through the respective passage and guide tube, and as it does so, it draws the attached group of elongate members through the passage and guide means so that the free ends 52 of the group of elongate members are brought to the position illustrated in FIG. 5*b*. This, in conjunction with the resilient means 76, ensures that the elongate members in each group are drawn fully though the passages and guide tubes to lie at the opposing side 41 of the apparatus from which the persons or dolls head is located and thereby ensures that the braid or plait which is formed is neat and tight.

Turning now to FIGS. 4*a* and *b* an embodiment of the internal assembly of the apparatus is shown in greater detail. It is shown how a single motor 94 is provided in the housing portion 4 and is connected via a gear box 96 to the gearing mechanism. The gearing mechanism includes a crank 98 and connecting arm 99 connected to the motor. The connecting arm 99 is connected to gear wheel 100 and has a natural arc of movement 101. Opposing ends 103, 105 of the movement are the end points of the movement of the arm and reverse the movement of the same along the arc. The connecting arm connects the crank to gear 100 via crank pins on each. The angular limit of movement of the gear 100 is controlled by the 'throw' of the crank arm 99' and the rotatable guides 12,14 contra rotate as a result of this, when moved. The gear wheel 100 is connected to turn both gear wheels 104, 104' in the same direction at the same time, and the respective gear wheels 104, 104' are coaxially located with larger gear wheels 74, 75. The gear wheels 74, 75 are linked by respective single pawl, single point clutches 107, 109, with a first clutch located between the gear wheel pair 104, 74 and the other clutch 109 located between the gear wheel pair 104, 75 an as to selectively drive the rotatable guides 12, 14 such that one rotatable guide 12 is driven by one gear wheel 74 for a first sequence and then the other rotatable guide 14 is driven by the other gear wheel 75 for a sequence and the same sequences are repeated. There is therefore provided a gearing mechanism which allows for the accurate and efficient control of the movement of the rotatable guides 12, 14 and hence shuttles 35, 36, 37 in the required configuration no as to provide the braiding and/or plaiting of elongate members such as lengths of hair. The crank arm 99 connects via the pins on the crank and gear 100 and the null points of movement are at the respective ends 103, 105 of the arc so as to ensure a smooth sinusoidal change of guide selection engages at a null point at one end of the arc and then accelerates in movement before decelerating to a null point at the other end of the arc before changing direction so the motor can continue to be operated at an optimum speed and therefore the smooth sinusoidal motion can be achieved without adversely affecting the operation of the motor.

Figure 6A:
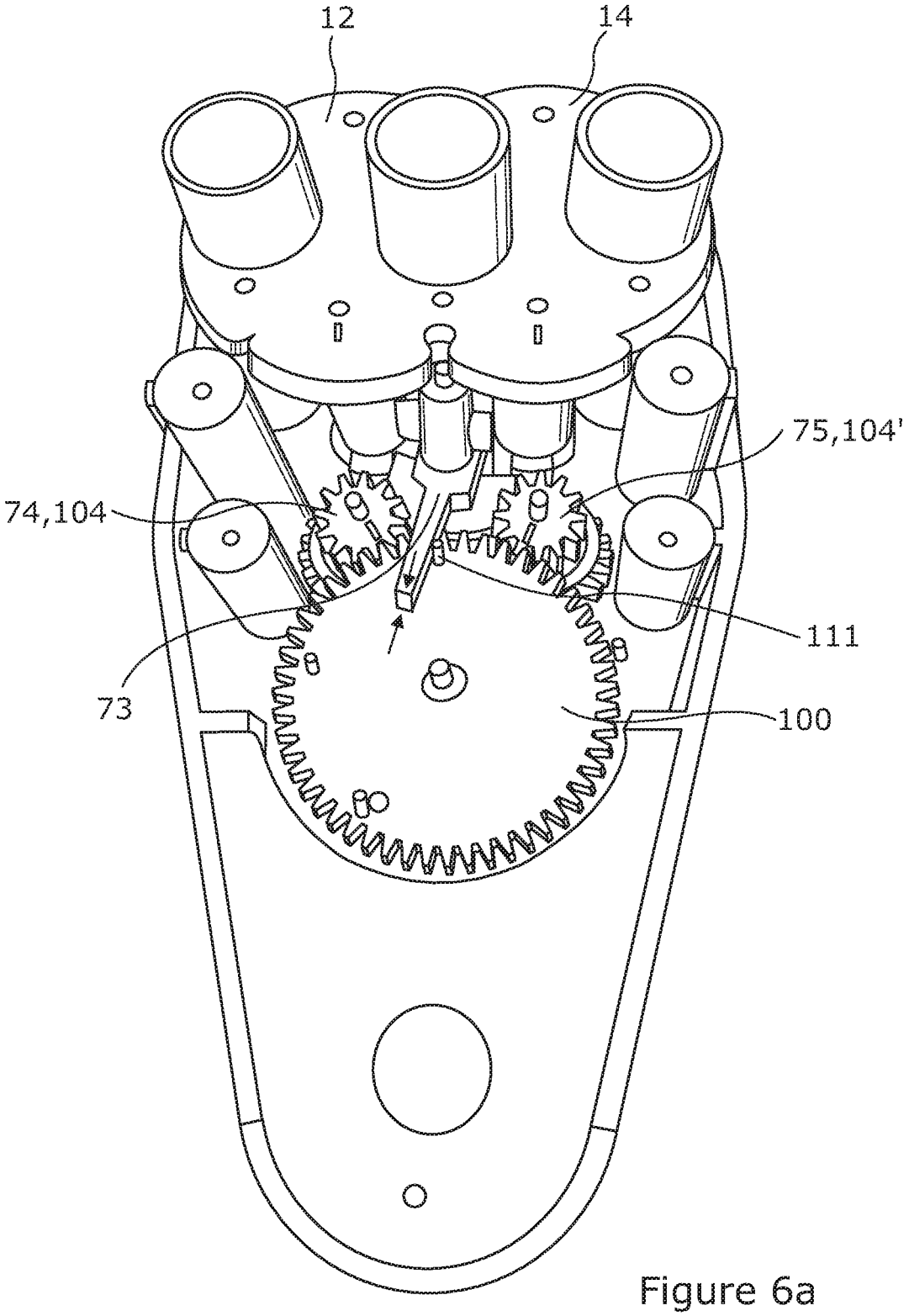
FIGS. 6*a* and 6*b* illustrate alternate views of a cam mechanism and secondary stop mechanism in accordance with one embodiment of the invention.
Figure 6B:
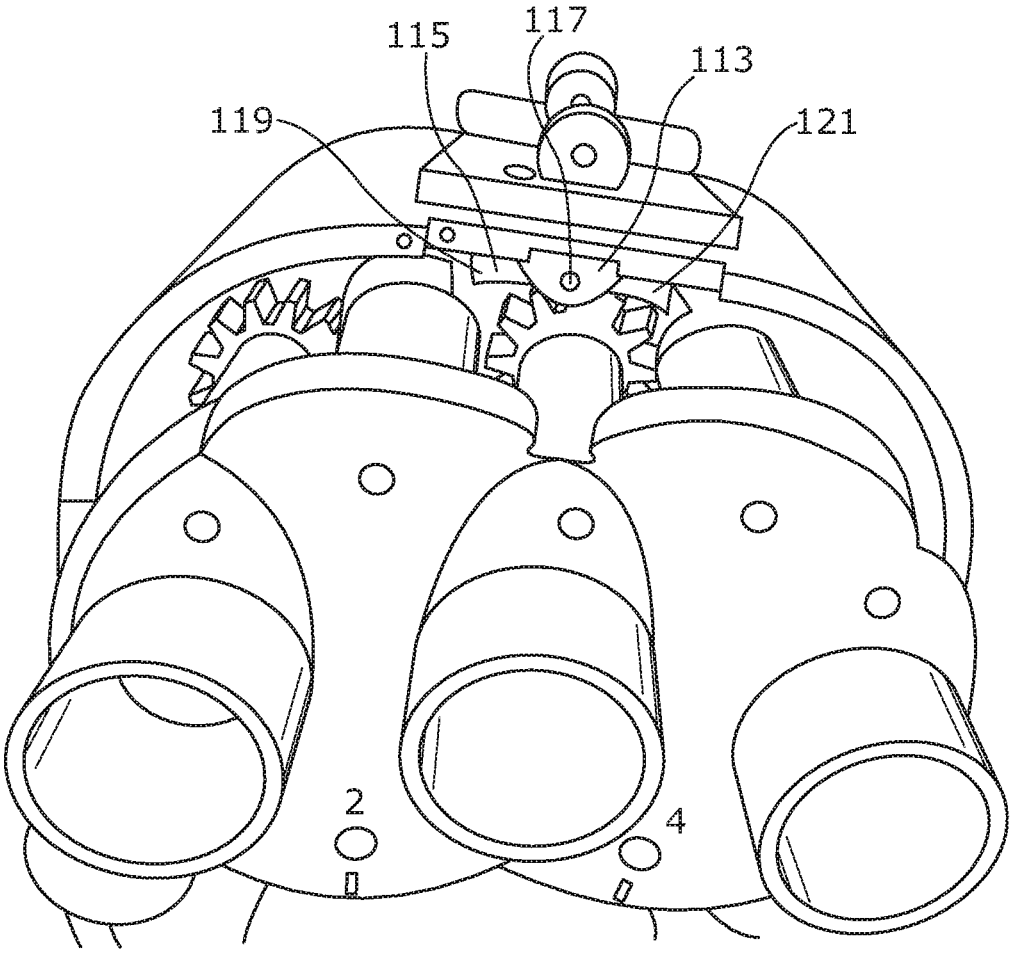

FIG. 6*a* illustrates a pin 111 on the gear wheel deflecting the cam 73 to restrain motion of one of the rotatable guides whilst allowing the other rotatable guide to be driven to rotate The pin 111 has a partner pin angularly displaced on gear 100 which reverses the status of the cam to allow for alternate motion of the rotatable guides 12, 14 and to position of the guides. FIG. 6*b* shows the secondary stop mechanism which includes a pawl 115 pivoted for rocking movement about pivot 117 and that can be positioned to prevent creep-back of the rotatable guides depending on which of the pawl arms, 119, 121 is moved inwardly about the pivot 117. Typically, both the cam and secondary stop are biased so as to remain neutral (central) when not influenced by pins 111.

There is therefore provided a method and apparatus which allows the improved and automated formation of braids in elongate members such as hair or hair extensions.

Whereas, the invention has been described in relation to the drawings attached hereto, it should be understood that other and further modifications, apart from those shown or suggested herein, may be made within the scope of this invention.

What is claimed is:

1. Apparatus for the weaving together of a plurality of elongate members, said apparatus comprising;

a weaving mechanism configured to move and weave respective elongate members together, said weaving mechanism comprising;

a) three shuttles, each having a passage to allow the elongate members to pass through the weaving mechanism and into guide tubes and to allow relative movement between the weaving mechanism and the elongate members as the weaving mechanism is operated weaves together the elongate members;

b) first and second rotatable guides in the weaving mechanism selectively driven about respective axes, the shuttles selectively moved via the first and second rotatable guides and selectively driven to move on a predefined path in combination and in sequence in a predefined manner to weave the elongate members;

said guide tubes in which the respective elongate members are received, are located to a first side of the weaving mechanism and an item to which at least some of the elongate members are attached located to the opposing side of the said weaving mechanism;

said apparatus further includes means to drive the weaving mechanism, said means connected to a crank and connecting arm which, in turn, is located to drive a gear wheel of a gearing mechanism to provide a sinusoidal motion to the weaving mechanism;

the gearing mechanism includes first and second clutches which are connected to the crank so as to sequentially drive the first and second rotatable guides, the first clutch located with a first pair of gear wheels coaxially mounted so that the first rotatable guide is driven to rotate and move two of the said shuttles and the second clutch located with a second pair of gear wheels coaxially mounted so that the second rotatable guide is driven to rotate and move two of said shuttles and the said sequence of movement of the respective rotatable guides is repeated, wherein the said connecting arm has an arc of movement with null points of movement at opposing ends of said arc; and in movement from a null point towards the other null point the speed of movement accelerates and then decelerates; and a cam which, when in a first position restrains motion of a first rotatable guide while the second rotatable guide is driven to be rotated and, when in a second position, restrains motion of the second rotatable guide while the first rotatable guide is driven to be rotated, and the movement of the cam between said first and second positions is caused by movement of the said gear wheel of said gearing mechanism.

2. Apparatus according to claim 1 wherein said means to drive is a motor connected to the crank.

* * * * *